US005342573A

United States Patent [19]

Amano et al.

[11] Patent Number: 5,342,573

[45] Date of Patent: Aug. 30, 1994

[54] METHOD OF PRODUCING A TUNGSTEN HEAVY ALLOY PRODUCT

[75] Inventors: Yoshinari Amano; Masahiro Omati; Junzo Matsumura, all of Itami, Japan

[73] Assignee: Sumitomo Electric Industries, Ltd., Osaka, Japan

[21] Appl. No.: 920,564

[22] PCT Filed: Mar. 21, 1992

[86] PCT. No.: PCT/JP92/00346

§ 371 Date: Aug. 20, 1992

§ 102(e) Date: Aug. 20, 1992

[30] Foreign Application Priority Data

| | | | |
|---|---|---|---|
| Apr. 23, 1991 | [JP] | Japan | 3-119285 |
| Apr. 23, 1991 | [JP] | Japan | 3-119286 |
| Apr. 23, 1991 | [JP] | Japan | 3-119288 |
| May 15, 1991 | [JP] | Japan | 3-139701 |
| Feb. 12, 1992 | [JP] | Japan | 4-58891 |
| Mar. 19, 1992 | [JP] | Japan | 4-93583 |
| Mar. 19, 1992 | [JP] | Japan | 4-93584 |

[51] Int. Cl.[5] ..... B22F 3/16

[52] U.S. Cl. ..... 419/38; 419/8; 419/23; 419/28; 419/29; 419/32; 419/36; 419/47; 419/54; 419/57; 419/58; 419/60; 428/548

[58] Field of Search ..... 75/247, 248, 249, 298; 148/126; 419/8, 23, 28, 29, 32, 36, 38, 47, 54, 57, 58, 60; 428/548

[56] References Cited

U.S. PATENT DOCUMENTS

| | | | |
|---|---|---|---|
| 4,801,330 | 1/1989 | Bose et al. | 75/298 |
| 4,986,961 | 1/1991 | Spencer et al. | 419/36 |
| 4,988,386 | 1/1991 | Denning et al. | 75/247 |
| 5,188,793 | 2/1993 | Nishio | 264/34 |
| 5,201,213 | 6/1991 | Nishio et al. | 419/36 |

FOREIGN PATENT DOCUMENTS 62-249712 10/1987 Japan .

*Primary Examiner*—Donald P. Walsh
*Assistant Examiner*—John N. Greaves
*Attorney, Agent, or Firm*—Wenderoth, Lind & Ponack

[57] ABSTRACT

A method of producing a tungsten heavy alloy product according to a powder metallurgical procedure utilizing the injection molding technique which enables production of tungsten heavy alloy products having high dimensional accuracy and complex configuration and yet having high physical strength and toughness in high productivity and at low cost. A powder mixture of tungsten powder and nickel powder, iron powder or copper powder is mixed with an organic binder and they are kneaded together. The kneaded mixture is injection molded into a predetermined shape, and thereafter the binder is removed from the molded product. Subsequently, the molded product is sintered in a temperature range of from the melting point of the bond phase of nickel, iron or copper to +50° C. relative to the melting point.

12 Claims, 1 Drawing Sheet

METHOD OF PRODUCING A TUNGSTEN HEAVY ALLOY PRODUCT

TECHNICAL FIELD

The present invention relates to a method of producing a tungsten heavy alloy product having a complex configuration and high strength by mixing material powder of a tungsten heavy alloy with an organic binder, injection molding the mixture into a molded material, then sintering the molded material.

BACKGROUND ART

A tungsten heavy alloy is composed of about 80% or more by weight of tungsten, and iron or copper, and especially where its tungsten content is more than about 90% by weight, the tungsten heavy alloy is called a tungsten superheavy alloy. Such a tungsten heavy alloy is becoming increasingly used in applications utilizing thermal expansion, such as thermal stress buffering for ceramic and metal materials, and applications requiring high mechanical strength, such as quills, shanks, and boring bars, as well as in such applications as automobile flyweights, spray nozzle weights, computer HDD weights, and VTR heads, which require a large weight though small in size.

Tungsten heavy alloys, including such tungsten superheavy alloys, have hitherto been produced by powder metallurgical techniques, because they contain a high melting-point tungsten. That is, W powder, Ni powder, and Fe powder or Cu powder are mixed in predetermined proportions, and the mixture powder is molded by a conventional press molding technique, such as pressing or CIP molding, the molded material being then sintered into a hard mass having a nearly perfect compact density. A similar powder metallurgical method is widely known for producing iron-base alloys.

However, such conventional powder metallurgical methods as mentioned above, wherein a molded material is obtained by press molding, have a disadvantage that the product to be produced is limited in configuration and dimensional accuracy. For example, press molding can produce no more than products of such a configuration as to permit the product to be monoaxially molded. CIP molding cannot provide high molding accuracy because molding is effected in a rubber mold, although it can produce a product of a tridimensional configuration. As such, in order to obtain the desired configuration for a final product, it is necessary to machine the product with respect to almost all portions thereof after the product has been sintered, which naturally means low productivity and increased costs.

When producing a composite product comprising a tungsten heavy alloy and an iron-base alloy or other metal material, it has been usual practice to join by silver brazing the alloy portions made to respective predetermined shapes by conventional powder metallurgical techniques, or to cast the tungsten heavy alloy portion, produced by a conventional powder metallurgical technique, in chills with an iron-base alloy or other metal material.

However, such a method does not provide a dependable junction or sufficient strength, and this constitutes a great limitation upon using the resulting product as a structural material.

In view of such disadvantages of the foregoing powder metallurgical methods, there have been developed methods as disclosed in Japanese Patent Publication No. 63-42682 and Japanese Patent Application Laid-Open Publication No. 62-250102, wherein metal or alloy powder is mixed with an organic binder and the mixture is injection-molded into a molded material which, in turn, is subjected to thermal decomposition in a non-oxidizing atmosphere or a similar debinding treatment for removal of the organic binder, the resulting product being then sintered.

Also, there has been known a method, as described in Japanese Patent Application Laid-Open Publication No. 62-249712, wherein a mixture of an organic binder and a material powder mass is injection-molded into a molded material which, in turn, is placed in a separate mold having a sufficient cavity, and wherein a mixture of same or different kind of material powder and an organic binder is injected into the cavity for being molded integrally with the previously molded material, the integral moldings being subjected to the step of debinding or binder removal and then sintered.

Various kinds of organic binders for use in mixture with the material powder have been known, including combinations of lubricants, such as atactic polypropylene, wax, and paraffin, with plasticizers, such as diethyl phthalate, as described in Japanese Patent Publication No. 51-29170; polyethylene, polystyrene, and beeswax, as described in Japanese Patent Application Laid-Open Publication No. 57-26105; and thermoplastic resins and silane or titanium coupling agents, as described in Japanese Patent Application Laid-Open Publication No. 55-113511.

A molded material produced by injection molding contains an organic binder and, therefore, must be heated for binder removal before it is sintered. In order to prevent the molded material from becoming deformed during that process, various methods have hitherto been in practice, including for example one in which the surface of the molded material is slightly oxidized for increasing the strength thereof, one in which such an amount of the binder as to permit the molded material to retain its form is intentionally retained, and one in which the binder removing step is carried out while the molded material is held as buried in a powdery alumina mass.

As separate means intended for this purpose, a debinding method utilizing an organic solvent has been proposed. In the specification of U.S. Pat. No. 4,765,950, for example, there is described a method wherein two kinds of organic binders, the one kind being soluble in a certain organic solvent, the other being sparingly soluble in the organic solvent, are used in combination, whereby the soluble organic binder will first be dissolved and extracted in the organic solvent so that open pores are formed in the molded material, the remaining sparingly soluble organic binder being then removed by heating.

In practice, however, in view of the fact that usually about 50% by volume of an organic binder is mixed with the material powder, it has been extremely difficult to inhibit the deformation of the molded product, even when the molded product is treated for binder removal prior to the sintering step, and further to completely remove the organic binder. In particular, such an injection molding method has been found to be impracticable for application to tungsten heavy alloys in its literal terms and also for application to other metals, for the following reasons.

First, when any existing method is employed in producing a tungsten heavy alloy product, the problem is that about 0.1% by weight of carbon will remain unremoved from the product after the step of debinding is carried out, with the result that the product is considerably degraded in strength and toughness by reason of the residual carbon. As such, the product thus produced is lower in strength and toughness than products made by a conventional powder metallurgical method using the pressure casting technique.

In order to obtain a product made of a tungsten heavy alloy material which meets both the strength and the toughness requirements of the product, it is essential that the residual carbon content be considerably lower than that in products made of any other metal material, such as an iron-base alloy. Additionally, it must be pointed out that such residual carbon is more likely to be present in a midinterior portion of the product, in the case where the product is relatively thick in section.

Second, in the binder removing stage, it has been usual practice to adopt such a low rate of temperature increase as not more than 20° C./hr in order to prevent the occurrence of cracking and/or creep strain with respect to the product, considerable time being thus required for binder removal. This has been a new cause of low productivity.

Third, during the stage of binder removal from the injection molded product, whether by heating or by extraction with an organic solvent, the tungsten heavy alloy molded product is liable to deformation under its own weight because the specific gravity of the product is considerably large.

It may be conceivable to use a method such that the molded product is buried in a powdery alumina mass as has often been practiced for binder removing purposes, but it must be noted that such method has been developed in the art of producing products of ceramics and other metal materials, such as iron-base alloys, whose specific gravity is relatively small. Therefore, it is impracticable to completely prevent the deformation of the molded product if the method is applied as such to the tungsten heavy alloy.

Fourth, for the purpose of solvent extraction, it has been extremely difficult to find a suitable combination of two kinds of organic binders for use with tungsten heavy alloys which have good moldability and will not separate from each other, and which have different solubility characteristics relative to the organic solvent used for extraction. In the process of such extraction by dissolution with solvent, the fact that the specific gravity of the tungsten heavy alloy is relatively large has often been responsible for defects such as deformations and/or cracks caused to the surface and/or interior of the molded material.

Because of the foregoing problems, it has been difficult to obtain stable quality products on a mass production basis.

Fifth, since the molded material passed through the step of binder removal has a porosity of about 50%, it is necessary that the molded material be subjected to liquid phase sintering usually under maximum temperature conditions, that is, within a temperature range of from the melting point of nickel, iron or copper bond phase and up to +50° C. thereabove, in order to bring the molded material to close proximity to the state of true density and, at same time, to facilitate the growth of tungsten particles to enable the molded material to have good toughness. In this case, when heating is effected continuously until the maximum temperature conditions are reached, the tungsten heavy alloy is likely to become deformed under its own weight because its bond phase tends to change abruptly into a liquid phase. Especially where products of a more complex configuration are required, the tungsten heavy alloy is liable to greater deformation; and as such it is impracticable to obtain a product having a high degree of dimensional accuracy.

Sixth, a problem exists with molded composites incorporating an iron-base alloy component formed integrally with a tungsten heavy alloy component. In Japanese Patent Application Laid-Open Publication No. 62-249712, for example, there is disclosed a method wherein a mixture of an organic binder and a certain metal powder material is injection-molded into a molded material which, in turn, is placed in a separate mold having a surplus cavity, and wherein a mixture of same or different kind of material powder and an organic binder is injected into the cavity for being molded integrally with the previously molded material, the integral moldings being subjected to the step of binder removal and then sintered.

However, most of the teachings given in such publication refer to cases in which same kinds of materials are used and, for the purpose of integrally complexing different kinds of materials into moldings and sintering the moldings, it is only stated therein that materials of a similar sintering temperature range should be selected, and that differences in their shrinkage behaviors due to sintering should be fully considered. In the case of a combination of such materials with a tungsten heavy alloy, it must be pointed out that sintering temperatures for the tungsten heavy alloy are generally 1300°–1450° C., while those for iron-base alloys are generally 1100°–1300° C. With such known method, therefore, as far as most tungsten heavy alloy compositions are concerned, it is impossible to sinter composite moldings of both tungsten heavy alloy and iron-base alloy components thereby to produce a tungsten heavy alloy—iron-base alloy composite product having high dimensional accuracy, a complex configuration, and yet having high strength and good toughness, in such a manner as to provide for high productivity.

OBJECTS OF THE INVENTION

In view of the problem of the prior art and with particular attention directed toward solving the foregoing problems inherent in tungsten heavy alloys, it is a primary object of the invention to provide a method for producing a tungsten heavy metal product which utilizes a powder metallurgical process using an injection molding technique to enable the product to have high dimensional precision and a complex configuration, and which, through selection of a suitable binder and an improved process for binder removal, provides for a substantial decrease in the residual carbon content of the product as compared with the level of such carbon content of conventional injection molded products. It is another object of the invention to provide a method of producing a tungsten heavy alloy product having high strength and excellent toughness at a high productivity rate.

Means for Achieving the Objects

In order to accomplish the above objects, according to the present invention there is provided a method of producing a tungsten heavy alloy product, which comprises the steps of:

(1) mixing 30–50 vol % of an organic binder system comprised of wax and polyethylene in a composition range of 1:1 to 4:1 by volume ratio with a mixture powder mass prepared by grinding tungsten, nickel, and iron or copper materials to a desired particle size and mixing them, relative to a total quantity of said powder mass plus said organic binder system, and kneading the mixture thus obtained.

(2) injection molding the kneaded mixture into similar moldings of a desired shape, (3) setting the moldings in a furnace by embedding them in or placing them on a powder mass including alumina or tungsten powder, heating the moldings to 300° C. at a heating rate of 20° to 50° C./hr starting with the room temperature, in a gaseous atmosphere in which hydrogen gas is predominant, or in a suitable non-oxidizing atmosphere, such as non-oxidizing gas vacuum, and then heating up to a temperature of 600° to 800° C. and, at this point of time, allowing the moldings to contain water vapor as required, thereby to remove the organic binder from the moldings, or as an alternative to this step, (4) vapor cleaning the injection moldings with a volatile organic solvent immiscible with the organic binder and having a boiling point lower than the boiling points or softening points of all ingredients of the organic binder, to thereby remove a slight amount of organic binder from the moldings, and then keeping the moldings in nitrogen or hydrogen or hydrogen gas at a temperature of 600° to 800° C. for removal of residual organic binder, and (5) burying the injection moldings in an alumina powder mass, wetting the entire alumina powder mass with a volatile organic solvent, then drying in a temperature range of room temperature to 100° C., and heating the moldings at a heating rate of 20° to 50° C./hr thereby to further remove organic binder, and (6) sintering the moldings freed from the organic binder in hydrogen gas in a temperature range of from −50° C. relative to the melting point of the nickel, iron or copper serving as a bond phase in the tungsten heavy alloy and up to a temperature lower than that melting point, until more than 90% of the theoretical density value is reached, then subjecting the moldings to final sintering in hydrogen gas in a temperature range of from the melting point of said bond phase and up to +50° C. relative to the melting point, and further comprising, for composite moldings of tungsten heavy alloy and iron-base alloy, (7) mixing 30–50 vol % of an organic binder comprised of wax and polyethylene in a composition range of 1:1 to 4:1 by volume ratio with a mixture powder mass prepared by grinding tungsten, nickel, and iron or copper materials to a particle size of not more than 5μ and mixing them, and likewise mixing 30–50 vol % of said organic binder with a mixture powder mass prepared by grinding iron-base alloys to a particle size of not more than 10μ and kneading the respective mixtures thus obtained, injection molding one of the kneaded mixtures into partial moldings, then placing the partial moldings in a separate mold having a surplus cavity and injection molding the other kneaded mixture thereinto, then subjecting the thus obtained composite moldings to one of the foregoing steps (3), (4), and (5) for removal of organic binder, and then sintering the composite moldings in vacuum at temperatures of 1200° to 1300° C.

Function and Effects

The method according to the invention is employed for production of tungsten heavy alloy products in a powder metallurgical way utilizing the injection molding technique. The term "tungsten heavy alloy" used herein means an alloy composed of more than 80% by weight of W, and other metal, such as Ni, Fe, or Cu, and includes a tungsten super heavy alloy having a W content of more than 90 wt %. The material powders are W powder and at least one kind of powder selected from the group consisting of Ni powder, Fe powder and Cu powder. The material powders are mixed together, with alcohol or the like, by employing a ball mill or attritor, in which they are ground while being mixed, into a powder mixture. The material powders, prior to grinding and mixing, are preferably of a particle size of not more than 20 μm, more preferably not more than 10 μm, in order for them to exhibit good sintering characteristics.

If the mixing and grinding of the material powders is insufficient, this adversely affects the sintering characteristics of the powder mixture, thus making it impracticable to obtain a sintered product having a sintered density close to true density. Preferably, therefore, the mixture powder, after mixing and grinding should have a particle size of not more than 3 μm. This powder is used as the starting powder.

For this purpose, a uniform mixture consisting of 60 to 80% by weight of tungsten powder having a comparatively small mean particle size of the order of 0.5 to 2 μm and 20 to 40% by weight of tungsten powder having a comparatively large mean particle size of the order of 5 to 15 μm is used as starting tungsten material powder. For mixture with this is used nickel powder, iron powder, or copper powder having a mean particle size of 1 to 5 μm in a predetermined proportion. Thus, by using tungsten powders of different particle sizes, coarse and fine, in mixture with nickel, iron or copper powder of a finer particle size, the bulk of the powder mixture is reduced and accordingly the quantity of the organic binder as required for molding purposes can be reduced by 5 to 15% in volume ratio. This makes it possible to obtain uniform and higher dimensional accuracy with respect to products, even if the products are of a thicker and larger type. Further, it is possible to obtain products having less residual carbon content.

Next, the mixture powder and organic binder are mixed and kneaded together.

The organic binder is comprised of a wax having a melting point of not more than not more than 100° C. and a polyethylene having a melting point of higher than the wax, the volume ratio of the wax to the polyethylene being within the range of 1:1 to 4:1. If the volume ratio is lower than 1:1, that is, the proportion of wax is smaller than that of polyethylene, the moldings are liable to formation of cracks during the stage of binder removing. If the ratio exceeds 4:1, the wax will begin to flow out at a temperature below 100° C., with the result that the moldings will become more porous and suffer from decreased strength, and further that the moldings, after the binder removing step, will suffer from increased residual carbon content.

The proportion of the organic binder relative to the powder mixture is 30 to 50 vol % of the total kneaded mass. The reason for this is that if the proportion of the organic binder is less than 30 vol %, the flow of the stock during the process of injection molding is unfavorable, while if the proportion exceeds 50 vol %, the moldings, after binder removal, will have increased porosity, which will result in lack of strength of the moldings and increased residual carbon content.

The above proportional limits are reduced to 25–35 vol % in the case of above described coarse-and-fine particle combination.

The kneaded mixture is molded into similar shapes of the desired configuration by employing the conventional injection molding technique.

Next, organic binder is removed from the moldings. For this purpose, various combinations of setting and heating conditions may be considered, but the following process of organic binder removal is most suitable for use with respect to the above described tungsten heavy alloy moldings.

The process is carried out in two stages. The first stage is such that the wax component of low melting point, as a main target for removal, is heated to melt and flow out or vapor cleaned with a volatile organic solvent slightly miscible with the organic binder and having a lower boiling point than the boiling point or softening point of all organic binder components, whereby it can be extracted.

In the second stage, remaining binder components are decomposed and caused to volatilize by heating in hydrogen gas.

In the first mentioned step for removal by hot-melting, it is desirable to heat the moldings in vacuum or non-oxidizing gas atmosphere to 300° C. within a heating-up range of 20° to 50° C./hr according to the shape of the moldings. If the heating-up rate exceeds 50° C./hr, the moldings are liable to deformation or creation of cracks.

If the heat-up rate is lower than 20° C./hr, more heating time than necessary is required, which is uneconomical from the standpoint of productivity. In order to dissolve the wax component for causing it to leach out and become decomposed, it is necessary that heating be effected to 300° C. under the abovementioned conditions.

In this way, by using such organic binder and such suitable conditions for binder removal as specified herein, it is possible to remove organic binder component from the moldings without cracks or creep deformation being caused to the moldings.

For the atmosphere in which this first binder removing step is carried out, it is only required that the atmosphere be suitable for preventing the oxidation of the components of the powder mixture; therefore, the binder removing step may be effectively carried out in vacuum or in a combination of non-oxidizing gases selected from such inert gases as hydrogen gas, and argon gas, though some different conditions may be considered depending upon the configuration of the moldings, and/or the manner of setting of the moldings in the furnace.

The second binder removing step is such that the moldings passed through the first step for binder removal are held in a temperature range of 600° to 800° C. in a hydrogen gas atmosphere, whereby the polyethylene component is decomposed and sublimated. The reasons why the step is carried out in a hydrogen gas atmosphere are that any gas other than hydrogen gas will not act to sufficiently remove the oxygen contained in the material powders and/or the oxygen which has been included as a consequence of subsequent mixing, grinding and kneading operations, and that the presence of oxygen will result in degraded mechanical characteristics of sintered moldings. The proportion of residual carbon in the moldings is reduced to a level of not more than 0.02 wt % as a result of this second binder removing step. In this case, by causing water vapor to be carried in the hydrogen gas, it is possible to reduce the residual carbon further to a level of 0.005 wt % and thus to significantly improve the mechanical characteristics of sintered moldings.

For this purpose, the amount of water vapor is preferably within the range of 10° to 20° C. at dew point.

In the above described heating treatment for binder removal, the manner for setting the moldings in position may be such that the moldings are simply set directly on a setter constructed of a refractory material or the like, or set on a thin layer of alumina or the like powder. Depending upon the shape of the moldings, it is possible to remove binder components from the moldings as set in such a simple manner while allowing the moldings to maintain their dimensional integrity and without deformation being caused under the foregoing temperature conditions. As already mentioned above, however, tungsten heavy alloys are susceptible to deformation by their own weight under heating, which fact makes it difficult to maintain the desired dimensional accuracy with respect to the moldings. Because of this fact, even in the art of making press formed products it has been necessary to embed press formed products in a layer of powdery alumina which does not react with the tungsten heavy metal component of the formed products.

In contrast to press formed products, injection molded products are subject to leach-out and decomposition/separation of binder components in large quantities during the stage of binder removal, which phenomenon involves considerable fluid stress. This is coupled with the fact that the components of the moldings are considerably heavy. Considering the difference in specific gravity between powder alumina and the moldings components, therefore, it is difficult to keep the moldings in shape simply by molding the alumina powder about the moldings.

A first means which was found by the present inventors to be effective for overcoming this difficulty was such that the moldings were buried in a molded alumina powder mass which in turn was compacted. It was found possible to provide good form retention in this way. For this purpose, the pressure for alumina powder compaction is preferably 0.2 kg/cm$^2$ to 5 kg/cm$^2$. If the pressure is lower than 0.2 kg/cm$^2$, the air in the alumina powder may not completely be removed and no good form retention can be achieved. If the pressure exceeds 5 kg/cm$^2$, the moldings contained in the alumina powder is liable to damage.

In the above case, the step of heating for binder removal should preferably be carried out in a nitrogen gas atmosphere under reduced pressure of 0.1 to 1.0 arm or under normal pressures. For heating-up programs, conditions similar to those for the first and second binder removing steps as earlier described may be used, but the final temperature range should preferably be 600° to 800° C. If the temperature is lower than 600° C., the moldings passed through the heating step will be of relatively low strength and may be difficult to handle. If the temperature exceeds 800° C., some difficulty will be encountered in separating the moldings from the alumina powder covering.

According to the above described procedure for binder removal, it is possible to almost completely retain the form of the moldings as injection molded, without any appreciable deformation. Further, it is possible to reduce the amount of residual carbon in the moldings to the tune of 0.002–0.005 wt % and thus to remove the organic binder components almost completely. Thus, sintered products having high strength characteristics can be obtained. The molding powder to be used in the invention is not limited to alumina, and any ceramic material may be equally used as such, provided that it does not react with the components of the moldings.

A second means which was found by the present inventors to be effective for preventing possible deformation was such that a tungsten powder material which is comparable in specific gravity to the constituents of the moldings, is unlikely to react with the moldings, and does not affect the process of sintering, or a powder material of a composition identical with or similar to that of the moldings, is molded about the moldings and then compacted, which was then subjected to the step of binder removing. It was found that a comparable effect could be achieved in this way. A third means which was found to be effective for preventing possible deformation was such that after an alumina mold covering the moldings was formed in same way as aforesaid first means, the entire mold was wetted by pouring water or a volatile organic solvent thereover, and the wetted mold was allowed to stand or made free from the water or organic solvent through evaporation thereof, and dried before it was passed through the heating step for binder removal. This procedure proved as effective as the above mentioned first and second means. Organic solvents for use in the above connection may be volatile organic solvents, such as alcohol, acetone, trichloroethane, carbon tetrachloride, and methylene chloride, and especially ethyl alcohol or methyl alcohol is preferred.

The molded structure, after wetted, is usually made free from the water or solvent with which it has been wetted, through evaporation thereof, before it is subjected to heating treatment for binder removal. However, when the molded structure is subjected to the binder removing treatment without passing through such process, the water or solvent can be evaporated during the first half portion of the heating up stage.

It is noted, however, that in order to prevent abrupt evaporation of organic solvent, the removal of the organic solvent by evaporation should preferably be completed in a temperature range of normal temperatures to 100° C., before the program for binder removing treatment begins.

By removing the organic solvent through evaporation in this way it is possible to efficiently eliminate air from the alumina powder mass and thus to retain the entire alumina powder mass in proper shape and in durable condition during subsequent binder removing stage. Therefore, the entire alumina powder mold and the moldings contained therein are prevented from getting out of shape and smooth binder removal is possible. The operating atmosphere and heating-up conditions during the subsequent binder removing stage may be same as those described with respect to the first means for deformation prevention.

Next, another alternative to the first stage binder removing procedure, or the process for binder removal through vapor cleaning and extraction of volatile organic solvent will be discussed in detail below.

According to the method of the invention, the moldings are vapor cleaned with a volatile organic solvent prior to the step of heat treatment for binder removal. During this stage, a slight amount of a soluble and extractable binder component representing a small proportion of the organic binder contained in the moldings is removed at a very slow rate, with the result that open pores are formed in the moldings.

Although the organic solvent used in connection with vapor cleaning should be volatile, it must be noted that if a solvent compatible with the organic binder used is employed, the organic binder will be dissolved and removed before open pores are formed in the moldings, it being thus impossible to retain the form of the moldings. Therefore, the organic solvent must be slightly soluble relative to the organic binder. Examples of such organic solvents include alcohol, acetone, trichloroethane, carbon tetrachloride, and methylene chloride. In particular, methyl alcohol and methylene chloride are preferred if the organic binder is of the paraffin base, and trichloroethane is preferred if the organic binder is of the wax-base.

Since tungsten heavy alloys have a large specific gravity, the moldings of such alloy are liable to deformation under their own weight even during the process of vapor cleaning. In order to prevent such deformation, it is desirable to use an organic solvent having a boiling point lower than the melting point or softening point of any binder component contained in the moldings. By using an organic solvent whose boiling point is lower than the melting point or softening point of the organic binder contained in the moldings, it is also possible to prevent the deformation of the moldings during subsequent stage of binder removal by heating. For example, possible volume expansion after binder removing treatment may be greatly restrained to the tune of 0 to about 0.5%. As compared with the method described in the specification of U.S. Pat. No. 4,765,950, wherein two kinds of organic binders are used, of which the one organic binder is dissolved and extracted in almost its entirety with an organic solvent, while the other organic binder is removed by heating, the method of the invention has great advantage in that it is much more effective in preventing possible deformation of the moldings and in enabling good form retention with respect to tungsten heavy alloy products.

Moldings which have passed through the stage of vapor cleaning are treated, according to the second stage heating program for binder removal of the invention as already described, in a hydrogen or nitrogen gas atmosphere under reduced pressure or normal pressures of, for example, 0.1 to 1.0 atm.

The effect of this initial binder removing step in preventing the deformation of the moldings through the use of solvent vapor, and the effect of that portion of the binder which has been left unremoved in restricting the amount of carbon residue are comparable to the effects of the previously described two-stage heating process. Furthermore, whereas, in the process of removing the binder by heating only, difficulties are had in shape retaining with respect to comparatively large-sized moldings (e.g., more than 50 mm in wall thickness), because of deformation and/or crack occurrences, according to this process of solvent vapor cleaning it is possible to remove the binder in short time and to minimize possible deformation of the moldings of such large size. Therefore, where the moldings are of comparatively small size, the heat-up rate for binder removal may be increased up to 100° C./hr max. Therefore, the time requirement for binder removing treatment can be further reduced in contrast to the process for binder removal through heating only. Hence, this process using solvent vapor can be advantageously employed for production of smaller size parts in large quantities.

It is noted that in this case, too, the moldings may be covered with a compacted mold of aforesaid alumina powder or tungsten-containing powder before it is passed through the stage of binder removing by vapor cleaning and heating, whereby possible deformation may be further reduced for improvement of dimensional accuracy.

For the second binder removing stage, it is also possible to use ultraviolet light in such a way that after binder extraction by vapor cleaning, the moldings are irradiated with ultraviolet light at low temperatures so that the binder content of the moldings is removed.

More specifically, injection moldings in which wax and polymethacrylate ester are used as organic binders are vapor cleaned with a volatile organic solvent having a boiling point lower than the melting point or softening point of the binder system, so that the wax binder is removed, and then the moldings are irradiated with ultraviolet light in an inert gas at temperatures of 100° to 250° C., whereby the polymethacrylate ester binder is removed. The present inventors have already found that this method is effective for removing binders from injection moldings.

The foregoing description refers to methods for injection molding and binder removing with respect to tungsten heavy alloy single-material products. For production of tungsten heavy alloy—iron-base alloy composite molded products, the method of the invention is briefly described as follows.

A mixed and kneaded mass of the one powder material is first injection molded into partial moldings, and then the moldings are set in a separate mold having a surplus cavity into which a mixed and kneaded mass of the other powder material is injected so that integral composite moldings are formed. Kinds and proportions of binders and conditions for the process of binder removing which are applicable for the above purpose are same as those described earlier.

Next, the step of sintering will be described.

In the case of tungsten heavy alloy products, the moldings passed through the binder removing stage are sintered in a hydrogen gas atmosphere to become final products.

Generally, the range of sintering temperatures is from the melting point of the bond phase for Ni and Fe or Cu and up to +50° C. relative thereto, preferably +30° C. to +40° C. relative to the melting point. Although the moldings may be densified by sintering at temperatures lower than the melting point of the bond phase, no sufficient toughness can be achieved in that case because the growth of tungsten particles is insufficient. If the sintering temperature exceeds +50° C. above the melting point of the bond phase, the tungsten heavy alloy is liable to deformation by gravity and, therefore, products having good dimensional accuracy cannot be obtained.

Where the products are of a complex configuration, two-stage sintering is preferred. In the first stage, solid phase sintering is carried out in the temperature range of −50° C. relative to the melting point of the nickel-iron or copper bond phase and to a temperature lower than the melting point, whereby a dimensional contraction of about 15 to 20% is effected to define a final product configuration which represents a denseness of 90 to 100% relative to the theoretical density. Since this first stage sintering is solid-phase sintering, it is possible to solidify the moldings without such deformation that the moldings get out of shape as has hitherto been often encountered. Next, the moldings are sintered in liquid phase within a temperature range of from the melting point of the nickel—iron or copper bond phase and to +50° C. above the melting point, whereby the growth of tungsten particles is facilitated to provide good toughness.

In the case of composite moldings of tungsten heavy alloy and Fe-base alloy, the moldings are sintered in vacuum at temperatures of 1200° to 1300° C. If sintering is effected in a hydrogen atmosphere, the carbon in the Fe-base alloy is removed, so that composition control is difficult. If the sintering temperature is lower than 1200° C., no sufficient denseness can be achieved, whereas if the temperature is higher than 1200° C., the Fe-base alloy tends to change into liquid phase, with the result that the moldings are likely to get out of shape. Although the sintering temperature range for tungsten heavy alloys is usually 1300° to 1450° C., it is noted that by previously controlling the particle size of tungsten heavy alloy mixture powder to not more than 5 μm, the tungsten heavy alloy component can be satisfactorily densified at aforesaid temperatures; thus, it is possible to provide high joint strength, sufficient toughness, and satisfactory dimensional accuracy.

Tungsten heavy alloy products produced in accordance with the method of the invention have only a very small amount of final carbon residue and, therefore, have as much denseness and as good strength characteristics as those produced by conventional emissivity metallurgical techniques. Furthermore, products of complex shape produced according to the method of the invention have excellent dimensional accuracy of such a level that could have not been achieved by the conventional powder metallurgy; therefore, they may be used as such in various applications, without post-sintering machining, such as cutting or the like.

Therefore, the method of the invention for production of tungsten heavy alloy products and integral composite products of tungsten heavy alloy and iron-base alloy by injection molding can contribute much toward the improvement of productivity in the art.

In the foregoing description, only iron-base alloy is mentioned as a companion material for making an integral composite molded product with tungsten heavy metal alloy, but it is to be understood that the binder arrangement and binder removing process according to the invention are also applicable to other metal materials and/or cermets, and therefore that the invention is not limited to examples given herein.

EXAMPLES

EXAMPLE 1

Figure 1:
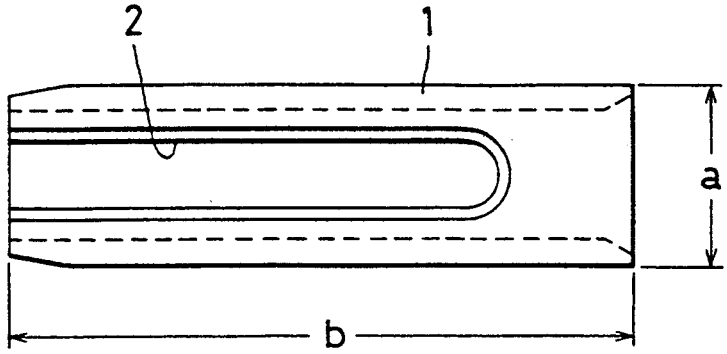
FIG. 1 is a plan view of a radiation shielding cover made in one example of the method of the invention.
Figure 2A:
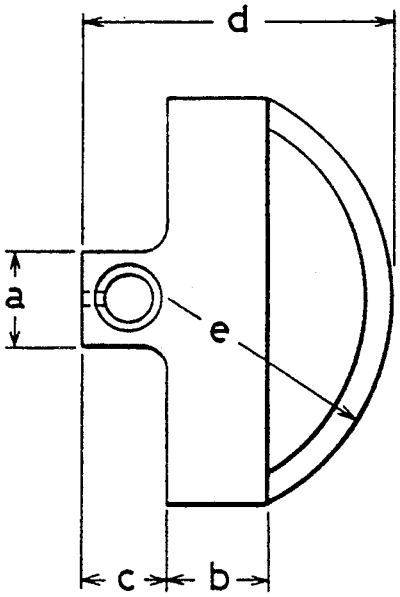
FIG. 2 (A) is a side view of a molded product obtained in another example, and FIG. 2 (B) is a plan view of same.
Figure 2B:
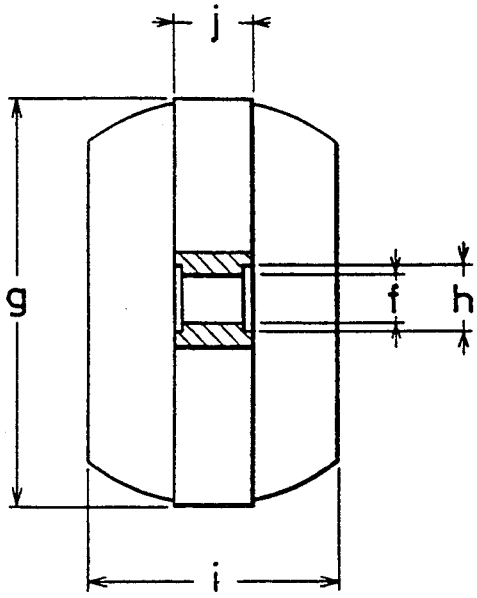

Three kinds of material powders, including W powder, Ni powder, and Fe powder (each of not more than 3 μm in particle diameter) were prepared, and they were mixed in a total quantity of 200 kgs in the proportions of 95.5% by weight of W, 3% by weight of Ni, and 1.5% by weight of Fe. The mixture was pulverized and mixed in ethyl alcohol by means of an attritor for 5 hrs. The particle diameter of the mixed powder was not more than 3 μm. To the mixed powder were added wax and polyethylene in varying volume ratios as shown, and the mixture was kneaded by a kneader for 3 hrs. The kneaded mixture was injection-molded under an injection pressure of 1000 $cm^2$ through a mold kept at the temperature of 40° C., into a shape analogous to a test specimen for tensile testing. Each molded product was subjected to binder-removal treatment by heating the same at such a heating rate as shown in Table 1 and up to 300° C. and successively heating it at 800° C. in a hydrogen gas containing a water vapor having a dew point of 15° C. The residual carbon value and surface appearance with respect to each molded product are shown in Table 1. Subsequently, each molded product was sintered in hydrogen gas at 1450° C. for 2 hrs. Specimens of individual alloys thus obtained were examined in respect of density and sectional configuration, and were also subjected to tensile testing at 1 mm/min for tensile strength and elongation measurement. The results are shown in Table 1.

the mixed powder was not more than 3 μm. To each powder mixture were added 30% of wax and 10% of polyethylene by volume ratio, and the resulting mixture was kneaded by a kneader for 3 hrs. The kneaded mixture was injection-molded under an injection pressure of 1000 $kg/cm^2$ through a mold kept at the temperature of 40° C., into a shape analogous to a test specimen for tensile testing. Each molded product thus obtained had a green density of 62% in terms of relative density.

Next, each molded product obtained was treated for binder removal by heating it in nitrogen gas under reduced pressure at a heating rate of 40° C./hr and up to 300° C. and successively heating it at 800° C. in a hydrogen gas containing a water vapor having a dew point of 15° C., for 30 min. The residual carbon value of each molded product after the two-stage binder removing treatment was about 0.002 wt %. At same time, the process of up to the first stage binder removing treatment was carried out with respect to the mixtures of compositions (2) W—Ni—Fe and (3) W—Ni—Cu, under same conditions, and for second stage binder removal, heat treatment was carried out in pure hydrogen at 800° C. for 30 min. In this case, the residual carbon in each molded product was 0.006 wt %. Subsequently, molded products were sintered in hydrogen gas and test samples formed of W super heavy alloy were thus obtained. Sintering temperatures were 1450° C. for compositions (1) and (2), both of W—Ni—Fe, and 1400° C. for composition (3) W—Ni—Cu. Sintering time was 2 hrs in all cases.

For purposes of comparison, a powder mixture of

TABLE 1

| | Binder Mix Ratio Wax: Polyethylene Volume % | | Injection Molding | Binder Removal Heat-up Rate °C./time | Moldings After Binder Removal Residual Carbon | Moldings After Binder Removal Appearance | Sintered Product Density g/cm | Sintered Product Section | Sintered Product Tensile strength kg/mm | Sintered Product Elongation % |
|---|---|---|---|---|---|---|---|---|---|---|
| *1 | 12.5 | 12.5 | Injection No Good | | | | | | | |
| *2 | 20 | 5 | Injection No Good | | | | | | | |
| *3 | 15 | 10 | Slight Shot Crack | 40 | 0.001 | Cracks | — | — | — | — |
| 4 | 24 | 6 | Injection Good | 40 | 0.001 | Good | 18.05 | Good | 65.0 | 15 |
| 5 | 20 | 20 | Injection Good | 40 | 0.001 | Good | 18.10 | Good | 65.0 | 15 |
| 6 | 30 | 10 | Injection Good | 20 | 0.001 | Good | 18.10 | Good | 65.2 | 18 |
| 7 | 30 | 10 | Injection Good | 40 | 0.002 | Good | 18.10 | Good | 65.2 | 18 |
| 8 | 20 | 10 | Injection Good | 50 | 0.002 | Good | 18.05 | Good | 65.0 | 17.5 |
| *9 | 30 | 10 | Injection Good | 60 | 0.005 | Deform Cracks | 18.00 | Cracks | — | — |
| *10 | 33 | 7 | Injection Good | 40 | 0.007 | Strength Low | 18.10 | Good | 45.0 | 5 |
| *11 | 27 | 27 | Injection Good | 40 | 0.007 | Str. Low, Cracks | 18.10 | Good | 45.0 | 2 |
| *12 | 44 | 10 | Injection Good | 40 | 0.007 | Str. Low, Cracks | 18.10 | Good | 43.2 | 2 |
| *13 | 33 | 7 | Injection Good | 40 | 0.007 | Str. Low, Cracks | 18.10 | Good | 42.5 | 2 |

Asterisks * represent reference examples given for comparison with the invention. Nos. 1 to 3 relate to cases where the total amount of binder is not more than 30 vol %; Nos. 11 and 12 relate to cases where the total amount of binder is more than 50 vol %; Nos. 10 and 13 relate to cases where the wax to polyethylene ratio is 4:1 or above; and No. 9 relates to cases where the rate of temperature rise, up to 300° C., for binder removal is 50° C./hr or more.

It may be understood from Table 1 that in each example under the conditions of the invention, the molded material, after binder removal, exhibited no abnormality and had much less residual carbon, and a sintered product having a high degree of denseness and excellent toughness was obtained.

EXAMPLE 2

Four kinds of material powder, including W powder, Ni powder, Fe powder, and Cu powder (each of not more than 3 μm in particle diameter) were prepared, and they were mixed in the following proportions by weight ratio: (1) 97% W:2% Ni:1% Fe; (2) 95.5% W:3% Ni:1.5% Fe; (3) 95% W:3% Ni:2% Cu. 200 $kg/cm^2$ each of the powder mixtures of compositions (1) to (3) were ground and mixed in ethyl alcohol by means of an attritor for 5 hrs. The particle diameter of same composition as aforesaid composition (2), i.e., 95.5% W—3% Ni—1.5% Fe, was, without being mixed with organic binder, formed into a shape analogous to the above mentioned test specimen according to the conventional press forming procedure. Subsequently, the formed product was sintered in hydrogen gas at 1450° C. for 2 hrs to provide a reference test sample.

The obtained test samples of respective W super alloy compositions were measured as to their degrees of density, which indicated that all samples were practically of true density. No nest was found in microscopic observations. Tensile tests were made with the samples under the condition of 1 mm/min for measurement of tensile strength and elongation. Rockwell hardness tests were also made for hardness measurement. The results of these tests are shown in Table 2 below.

TABLE 2

| Sample No. | Alloy Composition (wt %) | Density | Tensile Strength (kg/mm$^2$) | Elongation (%) | Hardness ($H_RC$) |
|---|---|---|---|---|---|
| (1) | 97W—2Ni—1Fe | 18.53 | 65.0 | 10 | 28 |
| (2) | 95.5W—3Ni—1.5Fe | 18.10 | 65.2 | 18 | 27 |
| (3) | 95W—3Ni—2Cu | 18.00 | 60.2 | 2 | 25 |
| *(4) | 95.5W—3Ni—1.5Fe | 18.10 | 65.5 | 20 | 27 |
| *(5) | 95.5W—3Ni—1.5Fe | 18.10 | 6.48 | 16 | 27 |
| *(6) | 95W—3Ni—2Cu | 18.00 | 59.8 | 1 | 25 |

Note)
Asterisks * all represent reference examples. No. 4 is a sample of same composition as No. 2 which was produced according to the conventional powder metallurgical procedure utilizing press forming technique; and Nos. 5 and 6 are samples of same compositions as Nos. 2 and 3 respectively which were produced in such a way that the post-injection second stage binder removing treatment was carried out in a pure hydrogen atmosphere.

It will be appreciated from the above that by carrying out the second stage binder removing treatment in a hydrogen atmosphere containing water vapor, the carbon content was reduced more than in the case of such treatment being carried out in a pure hydrogen atmosphere therefore, the strength and toughness of the sintered product is improved, it being thus possible to obtain a product of such strength/toughness level as is comparable to conventional press-formed products.

EXAMPLE 3

Material powders, i.e., W powder, Ni powder, and Fe powder (each of not more than 3 μm in particle diameter) were prepared, and they were mixed in a weight ratio of 97% W—2% Ni—1% Fe. The mixture was ground and mixed in ethyl alcohol by means of an attritor for 5 hrs. The particle diameter of the mixed material powder was not more than 2 μm. To the mixed material powder were added wax and polyethylene in the volume ratio of the former 30% and the latter 10%; and the mixture was kneaded by a kneader for 3 hrs.

The kneaded mixture was injection-molded under an injection pressure of 1000 kgs/cm$^2$ through a mold kept at the temperature of 40° C., and thus a molded product of a shape analogous to a product shape shown in FIG. 1. The green density of the molded product was 62% in terms of relative density. It is noted that the product shape shown in FIG. 1 represents a radiation shielding cover 1 to be fitted over a radial material injector which has a cutout 2 extending axially from one end of the cover 1 of a generally cylindrical shape and which is tapered at one outer peripheral end and at the opposite inner peripheral end. Main standard dimensions of the cover 1 are: inner diameter, 13.5 mm; outer diameter (a), 15.5 mm; and overall length, 57.7 mm.

Next, the molded product was treated for binder removal by heating it in nitrogen gas under reduced pressure at a heating rate of 40° C./hr and up to 300° C. and successively heating it at 800° C. in a hydrogen gas containing a water vapor having a dew point of 15° C., for 30 min. The residual carbon value of the molded product after the two-stage binder removing treatment was about 0.002 wt %. Subsequently, the molded product was sintered in solid phase in hydrogen gas at 1380° C. for 3 hrs, into a sintered product having a density of 18.53 g/cm$^2$ (100% relative to theoretical density), which in turn was sintered in liquid phase in hydrogen gas at 1460° C. into a final product.

Dimensional measurements were made with respect to various parts of a plurality of final products obtained in this way, to find average values x for outer diameter a and overall length b and variance $\sigma$ thereof. The results are shown in Table 3 below. Test specimens cut from the final products were tested for measurement of their tensile strength, elongation and Rockwell hardness. Results of these tests are also shown in Table 3. For purposes of comparison, similar measurements were made with respect to reference materials 1 which were produced in same way as above except that solid phase sintering at 1380° C. was not carried out, and reference materials 2 which were produced in such a way that a material powder mixture of same compositions as above was press formed into a round bar shape without being mixed with an organic binder, the press formed material being sintered in liquid phase at 1460° C. without being subjected to solid phase sintering at 1380° C. The results with respect to these reference materials are also shown in Table 3.

TABLE 3

| Sample | Outer Diameter a (15.5 mm) | | Overall Length b (57.5 mm) | | Tensile Strength (kg/mm$^2$) | Elongation (%) | Hardness ($H_RC$) |
|---|---|---|---|---|---|---|---|
| | Average x | Variance $\sigma$ | Average x | Variance $\sigma$ | | | |
| 1 | 15.45 | 0.085 | 57.53 | 0.123 | 65.0 | 10 | 28 |
| Reference 1 | 15.48 | 0.235 | 57.42 | 0.248 | 65.0 | 10 | 28 |
| Reference 2 | — | — | — | — | 65.0 | 10 | 28 |

It is noted that reference 2 materials, produced according to conventional press forming technique, were omitted from dimensional comparison because of their round bar shape.

It can be understood from the foregoing result that in the case of products of such thin-gauge type liable to deformation as in the present example, which are of the same composition and produced under the same conditions up to the binder removing stage, a first sintering stage be carried out in solid phase to obtain a density of more than 90% and then a second sintering stage be carried out in liquid phase (sample 1), which provides considerable advantage over the case in which sintering is carried out in liquid phase only in that variance $\sigma$ in dimensions is extremely small, and which also provides good strength and toughness of a level comparable to reference 2 products produced by conventional press forming technique

EXAMPLE 4

Material powders, i.e., W powder, carbonyl Ni powder, carbonyl Fe powder, and electrolyzed Cu powder (each of 2 to 3μm in particle diameter) were prepared, and they were mixed in a weight ratio of 95.0% W—3.0% Cu—1.6 Ni—0.4% Fe. The mixture was ground and mixed by means of an attritor for 6 hrs and was sifted out by a 150-mesh sieve. To 30 kg of the powder mixture were added 300 g of polyethylene and 600 g of wax as binders, and the resulting mixture was kneaded by a kneader for 3 hrs. The kneaded mixture was injection molded by an injection molder having a 20-ton locking force, with a two-impression tool of 20 mm length×10 mm width×5 mm height kept at 40° C. The molded part was buried in alumina powder, and then the alumina powder was compacted under a pressure of 5 kg/cm$^2$. The molded part as buried in the alumina powder, in its entirety, was heated in nitrogen gas under a reduced pressure of 0.5 atm at a heat-up rate of 20° C./hr and up to 300° C. at which temperature it was kept for 5 hrs. Then, the molded part was heated at a heat-up rate of 50° C./hr and up to 700° C. In this way was carried out the process of binder removing. The carbon residue in the molded part was 0.004 wt %. Subsequently, the molded part thus treated for binder removal was sintered in a hydrogen gas atmosphere at 1400° C.

The sintered product thus obtained had a density of 18.10 g/cm$^3$ and a texture similar to that of a conventional press formed product as sintered. In photomicroscopic observations of 100× magnification, there was found no nest or bond-phase segregation, which proved that the sintered product was of a normal W—Ni—Cu—Fe super heavy alloy. This W super heavy alloy had a hardness of 310 Hv (26 $H_RC$) and a tensile strength of 60 kg/mm$^2$, which showed that it had mechanical characteristics of same level as conventional press formed and sintered products. Dimensional measurements of the obtained sintered product indicated that the product had only a negligible longitudinal distortion or warpage during the binder removing stage which was limited to no more than 0.05 mm.

EXAMPLE 5

Material powders, i.e., W powder, carbonyl Ni powder, carbonyl Fe powder, and electrolyzed Cu powder (each of 2 to 3 μm in particle diameter) were prepared, and they were mixed in a weight ratio of 95.0% W—3.0% Cu—1.6% Ni—0.4% Fe. The mixture was ground and mixed by means of an attritor for 6 hrs and was sifted out by a 150-mesh sieve. To 30 kg of the powder mixture were added 300 g of polyethylene and 600 g of wax as binders, and the resulting mixture was kneaded by a kneader for 3 hrs. The kneaded mixture was injection molded by an injection molder having a 20-ton locking force, with a two-impression tool of 20 mm length×10 mm width×5 mm height kept at 50° C.

The molded part was buried in alumina powder, and then ethyl alcohol was poured over the alumina powder to sufficiently wet the entire alumina powder. The wet alumina powder, in its entirety, was kept at room temperatures for 24 hrs to allow the ethyl alcohol to evaporate. Then, the alumina powder, as retained in shape with the molded part enclosed therein, was heated in nitrogen gas under a reduced pressure of 0.5 atm at a heat-up rate of 20° C./hr and up to 300° C. at which temperature it was kept for 5 hrs. Then, the alumina powder was heated as such at a heat-up rate of 50° C./hr and up to 700° C. In this way was carried out the process of binder removing. The carbon residue in the molded part was 0.004 wt %. For comparison purposes, another molded part was set on a thin layer of alumina powder and the foregoing process of binder removing was simultaneously carried out. The longitudinal warpage caused to molded part as measured after the binder removing stage was not more than 0.01 mm with respect to the one buried in alumina powder, whereas it was 0.05 mm with respect to the one placed on alumina powder. Subsequently, the molded part thus treated for binder removal was removed from the alumina powder and sintered in a hydrogen gas atmosphere at 1400° C.

The sintered product thus obtained had a density of 18.10 g/cm$^3$ and a texture similar to that of a conventional press formed product as sintered. In photomicroscopic observations of 100× magnification, there was found no nest or bond-phase segregation, which proved that the sintered product was of a uniform and normal W—Ni—Cu—Fe super heavy alloy. This W super heavy alloy had a hardness of 310 Hv (26 $H_RC$) and a tensile strength of 60 kg/mm$^2$, which showed that it had mechanical characteristics of same level as conventional press formed and sintered products. Dimensional measurements of the obtained sintered product indicated that the product had only a negligible longitudinal distortion or warpage during the binder removing stage which was limited to no more than 0.05 mm. The comparison another molded part, which was subjected to the binder removing treatment as it was placed on a thin layer of alumina powder, had a longitudinal warpage of 0.10 mm.

Separately, a sintered product was produced in same way as above described, except that in order to retain the shape of the alumina powder in which the molded part was buried, methylene chloride was used instead of ethyl alcohol to wet the alumina powder, and the alumina powder, in its entirety, was vapor-dried in a reduced-pressure atmosphere. As a result, a normal W—Ni—Cu—Fe super heavy alloy having the same good characteristic as described above was obtained.

EXAMPLE 6

Material powders, i.e., W powder, carbonyl Ni powder, carbonyl Fe powder, and electrolyzed Cu powder (each of 2 to 3μm in particle diameter) were prepared, and they were mixed in a weight ratio of 95.0% W—3.0% Cu 1.6% Ni—0.4% Fe. The mixture was ground and mixed by means of an attritor for 6 hrs and was sifted out by a 150-mesh sieve. To 30 kg of the powder mixture were added 300 g of polyethylene and 600 g of wax as binders, and the resulting mixture was kneaded by a kneader for 3 hrs. The kneaded mixture was injection molded by an injection molder having a 20-ton locking force, with a two-impression tool of 20 mm length×10 mm width×5 mm height kept at 50° C. The molded part thus obtained was buried in W powder and heated in nitrogen gas at a heat-up rate of 30° C./hr and up to 300° C. at which temperature it was kept for 5 hrs. Then, the molded part was heated at a heat-up rate of 50° C./hr and up to 700° C. In this way was carried out the binder removing process. The carbon residue in the molded part was 0.004 wt %. Subsequently, the molded part thus treated for binder removal was sintered in a hydrogen gas atmosphere at 1400° C.

The sintered product thus obtained had a density of 18.10 g/cm$^3$ and a texture similar to that of a conventional press formed product as sintered. In photomicroscopic observations of 100× magnification, there was found no nest or bond-phase segregation, which proved that the sintered product was of a uniform and normal W—Ni—Cu—Fe super heavy alloy. This W super heavy alloy had a hardness of 310 Hv (26 $H_RC$) and a tensile strength of 60 kg/mm$^2$, which showed that it had mechanical characteristics of the same level as conventional press formed and sintered products. Dimensional measurements of the obtained sintered product indicated that the product had only a negligible longitudinal distortion or warpage during the binder removing stage which was limited to no more than 0.05 mm.

EXAMPLE 7

Material powders, i.e., W powder, carbonyl Ni powder, carbonyl Fe powder, and electrolyzed Cu powder (each of 2 to 3 μm in particle diameter) were prepared, and they were mixed in a weight ratio of 95.0% W—3.0% Cu—1.6% Ni—0.4% Fe. The mixture was ground and mixed by means of an attritor for 6 hrs and was sifted out by a 150-mesh sieve. To 30 kg of the powder mixture were added 300 g of polyethylene (with a softening point of 110° C.) and 600 g of wax (with a melting point of 80° C.) as binders, and the resulting mixture was kneaded by a kneader for 3 hrs. The kneaded mixture was injection molded by an injection molder having a 20-ton locking force, with a two-impression tool of 20 mm length×10 mm width×5 mm height kept at 50° C.

The obtained molded part was placed in a vapor cleaning apparatus, in which it was subjected to vapor cleaning for 1 hr by using trichloroethane (having a boiling point of 74.0° C.) as a volatile organic solvent. Then, binder removing treatment was carried out by heating the molded part in nitrogen gas under a reduced pressure of 0.5 arm at a heat-up rate of 20° C./hr and up to 300° C., and successively heating it up to 700° C. at a heat-up rate of 50° C./hr. The carbon residue in the molded part as measured after the carbon removing stage was 0.003 wt %. Also, with respect to a molded part which passed through the steam cleaning stage, binder removing treatment was carried out by heating it in the same atmosphere as above described at a heat-up rate of 20° C./hr and up to 300° C., and then heating up to 700° C. at a faster heat-up rate. In this case, too, the carbon residue was 0.003 wt % or no change. Subsequently, the molded part passed through the binder removing stage was sintered in a hydrogen gas atmosphere at 1400° C.

The sintered product thus obtained had a density of 18.10 g/cm$^3$ and a texture similar to that of a conventional press formed product as sintered. In photomicroscopic observations of 100× magnification, there was found no nest or bond-phase segregation, which proved that the sintered product was of a normal W—Ni—Cu—Fe super heavy alloy. This W super heavy alloy had a hardness of 310 Hv (26 $H_RC$) and a tensile strength of 60 kg/mm$^2$, which showed that its mechanical characteristics were of the same level as conventional press formed and sintered products.

Further, with respect to the distortion considered to have been caused to the molded part during the binder removing stage, the dimensional measurements of the obtained sintered product indicated that the longitudinal distortion was restrained to not more than 0.2 mm irrespective of the heating-up rate (whether 50° C. or 80° C.) in the binder removing stage. In order to further reduce such distortion in the binder removing stage, after the molded part was buried in tungsten powder, steam cleaning and binder removing steps were carried out in same way as described above, and then the molded part was sintered into a sintered product. As a result, a normal W super heavy alloy having same characteristics as above noted was obtained and it was found that the longitudinal distortion considered to have been caused to the molded part during the binder removing stage was restrained to not more than 0.05 mm.

EXAMPLE 8

As material powders were prepared W powder having a mean particle diameter of 1.5μ and W powder having a mean particle diameter of 10μ and Ni and Fe powders having a mean particle diameter of 3μ were prepared, and the powders were blended in the weight ratio of 97.0% W—2.0% Ni—1.0% Fe. Of these powders, the ratio of W powder of 1.5μ mean diameter to W powder of 10μ mean diameter was 70:30. 200 kg of the blended powder were mixed in methyl alcohol by means of attritor for 5 hrs. The powder mixture was sifted out by a 150-mesh sieve. To 30 kg of the mixture powder passed through the sieve were added 30 vol % of wax and polyethylene proportioned in the ratio of 2:1, and the resulting mixture was kneaded by a kneader for 30 hrs.

The mixture was injection molded through a mold kept at 40° C. and under an injection pressure of 1000 kg/cm$^2$, and a molded part analogous to the product shape shown in FIG. 1 was produced. The product shape shown in FIG. 1 represents a radiation shielding cover 1 to be fitted over a radial material injector which has a cutout 2 extending axially from one end of the cover 1 of a generally cylindrical shape and which is tapered at one outer peripheral end and at the opposite inner peripheral end. Main standard dimensions of the cover 1 are: inner diameter, 13.5 mm; outer diameter, 15.5 mm; and overall length, 57.7 mm.

Next, the molded product was treated for binder removal by heating It in nitrogen gas under reduced pressure at a heating rate of 40° C./hr and up to 300° C. and successively heating it at 800° C. in a hydrogen gas containing a water vapor having a dew point of 15° C., for 30 min. The residual carbon value of the molded product after the two-stage binder removing treatment was about 0.002 wt %. Subsequently, the molded product was sintered in solid phase in hydrogen gas at 1250° C. for 3 hrs, into a sintered product having a density of 18.53 g/cm$^3$ (theoretical density ratio: 100%), which in turn was sintered in liquid phase in hydrogen gas at 1350° C. into a final product.

Dimensional measurements were made with respect to various parts of a plurality of final products obtained in this way, to find average values x for outer diameter a and overall length b and variance $\sigma$ thereof. The results are shown in Table 4 below. Test specimens cut from the final products were tested for measurement of their tensile strength, elongation and Rockwell hardness. Results of these tests are also shown in Table 4. For purposes of comparison, similar measurements were made with respect to samples 2 of the invention which were produced in same way as above except that solid phase sintering at 1250° C. was not carried out, and reference samples which were produced in such a way that a material powder mixture of the same composition as above was press formed into a round bar shape without being mixed with an organic binder, the press formed material being sintered in liquid phase at 1350° C. without being subjected to solid phase sintering at 1250° C. The results with respect to these samples are also shown in Table 4.

TABLE 4

| Sample | Outer Diameter a (15.5 mm) Average x | Outer Diameter a (15.5 mm) Variance σ | Overall Length b (57.5 mm) Average x | Overall Length b (57.5 mm) Variance σ | Tensile Strength (kg/mm²) | Elongation (%) | Hardness ($H_RC$) |
|---|---|---|---|---|---|---|---|
| Invention 1 | 15.45 | 0.050 | 57.53 | 0.095 | 67.0 | 11 | 28 |
| Invention 2 | 15.48 | 0.235 | 57.42 | 0.248 | 65.0 | 10 | 28 |
| Reference 1 | — | — | — | — | 65.0 | 10 | 28 |

It can be understood from the above that the W heavy alloy product according to the invention involves much less pores after organic binder removal as compared with conventional products and has excellent dimensional accuracy because of the fact that possible deformation during the sintering stage can be effectively prevented, and that it has such level of strength and toughness as is comparable to products produced according to conventional powder metallurgical procedure.

EXAMPLE 9

The injection molded product obtained in Example 8 was steam-cleaned in a steam cleaning apparatus using trichloroethane as a volatile organic solvent, for 5 hrs. Then, it was heated for binder removal in a hydrogen gas containing a water vapor having a dew point of 15° C., at 800° C. for 30 min. Subsequently, the molded product was sintered in the same way as in Example 8 and thus a final product was obtained. The obtained product had same level of dimensional accuracy and mechanical characteristics as the Example 8 product.

EXAMPLE 10

As material powders were prepared W powder having a mean particle diameter of 1.5μ and W powder having a mean particle diameter of 10μ and Ni and Fe powders having a mean particle diameter of 3μ were prepared, and the powders were blended in the weight ratio of 97.0% W—2.0% Ni—1.0% Fe. Of these powders, the ratio of W powder of 1.5μ mean diameter to W powder of 10μ mean diameter was 70:30. 200 kg of the blended powder were mixed in methyl alcohol by means of attritor for 5 hrs. The powder mixture was sifted out by a 150-mesh sieve. To 30 kg of the mixture powder passed through the sieve were added 30 vol % of wax and polyethylene proportioned in the ratio of 2:1, and the resulting mixture was kneaded by a kneader for 30 hrs.

The mixture was injection molded through a mold kept at 40° C. and under an injection pressure of 1000 kg/cm², and a molded part analogous to the product shape shown in FIG. 1 was produced.

Next, the molded part was steam-cleaned in a steam cleaning apparatus using trichloroethane as a volatile organic solvent. Then, it was placed in a tank in a nitrogen atmosphere and irradiated with ultraviolet light, with the heater temperature raised to 200°C. which was kept for 50 hrs. The residual carbon value of the molded product after the binder removing treatment was about 0.05 wt %. Subsequently, the molded product was sintered in solid phase in hydrogen gas at 1250° C. for 3 hrs, into a sintered product having a density of 18.53 g/cm³, which in turn was sintered in liquid phase in hydrogen gas at 1450° C. into a final product.

Dimensional measurements were made with respect to various parts of a plurality of final products obtained in this way, to find average dimensional values x and variance σ thereof. The results are shown in Table 5 below. Test specimens cut from the final products were tested for measurement of their tensile strength, elongation and Rockwell hardness. Results of these test are also shown in Table 5. For purposes of composition, similar measurements were made with respect to reference samples 1 which were produced in same way as above except that solid phase sintering at 1250° C. was omitted, and reference samples 2 which were produced in such a way that a material powder mixture of same composition as above was press formed without being mixed with an organic binder, the press formed material being sintered in liquid phase at 1350° C. without being subjected to solid phase sintering at 1250° C. The results with respect to these samples are also shown in Table 5.

TABLE 5

| | Invention | | Reference 1 | | Reference 2 |
|---|---|---|---|---|---|
| Tensile Strength kg/mm² | 67.0 | | 65.0 | | 65.0 |
| Elongation % | 11.0 | | 10.0 | | 10.0 |
| Hardness $H_RC$ | 28 | | 28 | | 28 |
| | Average x | Variance π4 | Average x | Variance σ | |
| Site | | | | | |
| 12 mm | 12.05 | 0.05 | 12.04 | 0.10 | |
| b 13 mm | 13.02 | 0.05 | 12.93 | 0.12 | |
| c 11 mm | 11.05 | 0.05 | 11.96 | 0.12 | |
| d 40.5 mm | 40.55 | 0.10 | 40.47 | 0.32 | |
| e 6.35 mm | 6.40 | 0.02 | 6.41 | 0.12 | |
| f 29.5 mm | 29.55 | 0.07 | 29.04 | 0.35 | |
| g 53 mm | 53.06 | 0.12 | 53.17 | 0.32 | |
| h 8.5 mm | 8.60 | 0.01 | 8.61 | 0.12 | |
| i 32 mm | 32.03 | 0.09 | 32.08 | 0.20 | |
| j 10 mm | 10.02 | 0.60 | 10.01 | 0.12 | |

It can be understood from Table 5 that the W heavy alloy product according to the invention involves much less pores after organic binder removal as compared with conventional products and has excellent dimensional accuracy because of the fact that possible deformation during the sintering stage can be effectively prevented, and that it has such level of strength and toughness as is comparable to products produced according to conventional powder metallurgical procedure.

EXAMPLE 11

As material powders were prepared W powder, Ni powder, Fe powder, and Cu powder (each of not more than 3 μm in particle diameter), and they were mixed in the following weight ratios: (1) 97.0% W—2.0% Ni—1.0% Fe; (2) 95.5% W—3% Ni—1.5% Fe; (3) 94% W—4% Ni—2% Cu. 200 kg each of the powder mixtures of compositions (1) to (3) were ground and mixed in ethyl alcohol by means of an attritor for 5 hrs. The particle diameter of the mixed powder was not more than 2 μm. Separately, as Fe-base alloy powders were prepared carbonyl Fe powder, carbonyl Ni powder, Fe—50% Ni alloy powder, SUS 304 powder, and C powder, and these powders were arranged alone or in mixture into the following compositions in weight ratio: (4) 98% Fe—2% Ni, (5) 97.7% Fe—2.0% Ni—0.3% C, (6) SUS 304. These powders were ground and mixed in same way as above. The particle diameter of the mixed powder was 10 μm.

Figure 3:
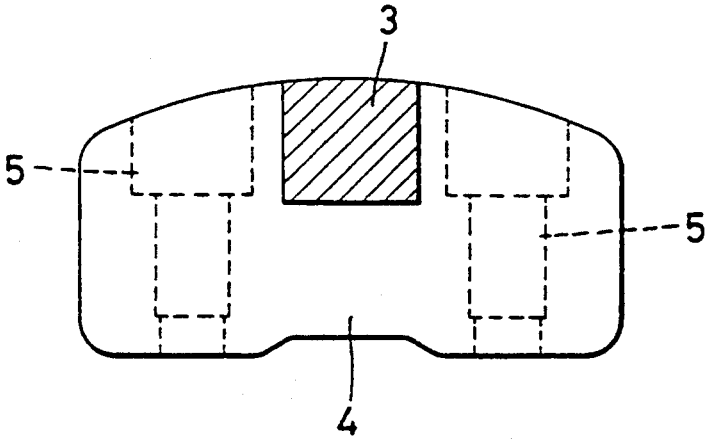
FIG. 3 is an explanatory view with respect to the molded product obtained in an example.

Then, to each powder mixture were added 30% of wax and 10% of polyethylene by volume ratio, and the resulting mixture was kneaded by a kneader for 3 hrs. Of the obtained kneaded mixtures, each W alloy mixture was injection molded through a mold kept at 40° C. under an injection pressure of 1000 kg/cm$^2$. As a result, a partial molded product 3 of about 28 mm length×30 mm width×10 mm thickness was obtained which had one curved lateral side having a curvature radius of about 130 mm as shown in FIG. 3, with respect to each W alloy mixture. Then, each partial molded product 3 was placed together with a core 4 in a separate mold having a surplus cavity 4, and each Fe-base alloy mixture, one for said each partial molded product, was injection molded under the same conditions as described above. As a result, a composite molded product of about 56 mm length×120 mm width×10 mm thickness was obtained which had one curved lateral side having a curvature radius of about 130 mm.

Next, each composite molded material thus obtained was treated for binder removal by heating it in nitrogen gas under reduced pressure at a heat-up rate of 40° C. and up to 300° C. and successively heating it in a hydrogen gas atmosphere containing water vapor having a dew point of 15° C. at 800° C. for 30 min. The carbon residue in each composite molded product as measured after binder removing treatment was about 0.002 wt %. Subsequently, each composite molded product was sintered in vacuum at 1250° C. for 3 hrs and thus a composite product of W heavy alloy and Fe-base alloy was produced. Each composite product obtained was free from any trace of sintering-stage deformation and had a satisfactory and defect-free joint interface. Theoretical density ratio and tensile strength measurements with respect to respective composite products are shown, together with alloy compositions of various composite parts, in Table 6.

TABLE 6

| Alloy Composition of Composite Parts (W heavy alloy - Fe alloy) | Theoretical Density Ratio (%) W heavy alloy | Fe alloy | Tensile Strength (kg/mm$^2$) |
|---|---|---|---|
| (1)-(2) | 100 | 93 | 30 |
| (2)-(6) | 100 | 85 | 30 |
| (3)-(4) | 100 | 93 | 25 |

What is claimed is:

1. A method of producing a tungsten heavy alloy product, comprising the steps of:

mixing and grinding tungsten powder having a particle size of not more than 20° μm and at least one member selected from the group consisting of nickel powder, iron powder and copper powder having a particle size of 1-5 μm to produce a mixed powder;

mixing the mixed powder with, as organic binder, wax and polyethylene in a volume ratio of wax to polyethylene within the range of 1:1 to 4:1, wherein the proportion of the organic binder to the mixed powder is 30 to 50% by volume;

kneading the resultant mixture;

injection molding the kneaded mixture into moldings of a predetermined configuration;

then removing the organic binder from the moldings by heating the moldings in vacuum or in non-oxidizing gas up to 300° C. at a heating-up rate of 20° to 50° C./hr, and then keeping the injection moldings in hydrogen gas at a temperature of 600° to 800° C.; and subsequently sintering the moldings in hydrogen gas in a temperature range of from the melting point of a bond phase of nickel, iron or copper to +50° C. relative to the melting point, to obtain the tungsten heavy alloy product, containing not more than 0.02 wt % residual carbon.

2. A method of producing a tungsten heavy alloy product as set forth in claim 1, wherein the moldings from which the organic binder has been removed are first sintered in hydrogen gas in a temperature range of from −50° C. relative to the melting point of nickel, iron or copper to a temperature lower than the melting point to a theoretical density ratio of more than 90%, the so sintered moldings being then sintered in hydrogen gas in a temperature range of from the melting point of the bond phase of nickel, iron or copper to +50° C. relative to the melting point.

3. A method of producing a tungsten heavy alloy product as set forth in claims 2 or 1, wherein the hydrogen gas in which the injection moldings are kept at 600° to 800° C. contains water vapor.

4. A method of producing a tungsten heavy alloy product as set forth in claims 2 or 1, wherein the injection moldings are buried in alumina powder or in a powder containing tungsten, and compacted, and wherein the binder is removed in a nonoxidizing gas atmosphere.

5. A method of producing a tungsten heavy alloy product as set forth in claims 2 or 1, wherein the injection moldings are buried in alumina powder and, the compacted alumina powder being then wetted in its entirety with volatile organic solvent or water and subsequently dried in a temperature range of room temperatures to 100° C. until the volatile organic solvent or water is removed, whereafter the organic binder is removed by heating in a nitrogen gas atmosphere of 0.1 to 1 atm at a heat-up rate of 20° to 50° C./hr.

6. A method of producing a tungsten heavy alloy product as set forth in claims 2 or 1, wherein the injection moldings are vapor-cleaned with a volatile organic solvent slightly miscible with the organic binder and having a boiling point lower than the melting point or softening point of any binder component contained in the moldings for removing a slight amount of organic binder from the moldings and are subsequently kept in nitrogen or hydrogen gas at temperatures of 600° to 800° C. for removing the remaining organic binder.

7. A method of producing a tungsten heavy alloy product as set forth in claim 6, wherein the volatile organic solvent is trichloroethane, methylene chloride, alcohol, acetone, or carbon tetrachloride.

8. A method of producing a tungsten heavy alloy product as set forth in claim 4, wherein the volatile organic solvent is trichloroethane, methylene chloride, alcohol, acetone, or carbon tetrachloride.

9. A method of producing a tungsten heavy alloy product as set forth in claim 5, wherein the volatile organic solvent is trichloroethane, methylene chloride, alcohol, acetone, or carbon tetrachloride.

10. A method of producing a tungsten heavy alloy-iron base alloy composite product, comprising the steps of:

mixing and grinding tungsten powder and at least one member selected from the group consisting of nickel powder, iron powder and copper powder to a particle diameter of not more than 5 μm to form a tungsten heavy alloy powder;

mixing and grinding a mixed material powder of iron base alloys to a particle diameter of not more than 10 μm to form an iron base alloy powder;

separately mixing the tungsten heavy alloy powder and the iron base alloy powder with, as organic binder, wax and polyethylene in a volume ratio of wax to polyethylene within the range of 1:1 to 4:1, wherein the proportion of the organic binder to the mixed powder is 30 to 50% by volume, said volume ratio of wax to polyethylene and said proportion of organic binder being selected to be identical in both the resultant tungsten heavy alloy mixture and the resultant iron base alloy mixture;

selecting either the tungsten heavy alloy mixture or the iron base alloy mixture and producing a partial molded product from the selected mixture in a first injection molding step;

placing the partial molded product formed in the first injection molding step in a separate mold having a surplus cavity and injecting the mixture not selected in the first injection molding step into the cavity to obtain a tungsten heavy alloy-iron base alloy composite product;

heating the obtained molded composite to 300° C. in vacuum or in non-oxidizing gas;

then keeping the molded composite at a temperature of 600° to 800° C. in hydrogen gas to thereby remove the organic binder; and subsequently sintering the composite in a temperature range of 1200° to 1300° C.

11. A method of producing a tungsten heavy alloy product as set forth in claim 2, 1 or 10, wherein the injection moldings are vapor-cleaned with a volatile organic solvent slightly miscible with the organic binder and having a boiling point lower than the melting point or softening point of any binder component contained in the moldings for removing a slight amount of organic binder from the moldings, and subsequently said moldings are irradiated with ultraviolet light at low temperatures for removing the remaining organic binder.

12. A method of producing a tungsten heavy alloy product as set forth in claim 2, 1 or 10, wherein the tungsten powder is a mixture of 60 to 80% by weight of tungsten powder having a mean particle size of 0.5 to 2 μm and 20 to 40% by weight of tungsten powder having a mean particle size of 5 to 15 μm.

* * * * *